United States Patent [19]

Yane et al.

[11] 4,390,776

[45] Jun. 28, 1983

[54] IMMERSION HEATER

[76] Inventors: Daryl J. Yane, 2735 Pioneer Trail, Aurora, Ohio 44202; Roger A. Yane, 954 Canyon View Rd., Sagamore Hills, Ohio 44067

[21] Appl. No.: 353,601

[22] Filed: Mar. 1, 1982

[51] Int. Cl.[3] ..... H05B 3/06

[52] U.S. Cl. ..... 219/523; 219/517; 219/528; 219/536; 219/544; 219/548; 219/552; 219/331

[58] Field of Search ..... 219/213, 331, 345, 517, 219/523, 528, 532, 536, 537, 538, 544, 545, 548, 549, 552, 553; 338/210, 214, 268

[56] References Cited

U.S. PATENT DOCUMENTS

| | | | |
|---|---|---|---|
| 3,144,545 | 8/1964 | Shrrimplin et al. | 219/213 |
| 3,171,015 | 2/1965 | Grinde | 219/523 X |
| 3,193,664 | 7/1965 | Beery | 219/549 |
| 3,476,915 | 11/1969 | Rapsis | 219/523 |
| 3,546,654 | 12/1970 | Royal et al. | 338/268 |
| 3,641,312 | 2/1972 | Ammerman et al. | 219/532 |
| 3,657,520 | 2/1972 | Ragault | 219/553 |
| 3,717,793 | 2/1973 | Peterson | 219/517 X |
| 3,803,386 | 4/1974 | Rodriques | 219/523 |
| 4,125,761 | 11/1978 | Churchill | 219/544 |
| 4,158,764 | 6/1979 | Yane | 219/523 |

*Primary Examiner*—Volodymyr Y. Mayewsky
*Attorney, Agent, or Firm*—R. A. Johnston; C. B. Fagan

[57] ABSTRACT

A continuous flexible cable heater having a coil continuous conductor in a plastic casing. The conductor has uncoiled regions spaced therealong between coiled regions to permit bending at a radius less than twice the jacket outside diameter. A heater assembly has the cable disposed on a support in closely folded serpentine planar array. A sensor portion of the continuous cable is folded over and adjacent the upper surface of the planar array and includes fusible protective means to cut off the heater in the event of overheating of the liquid or excess current draw.

8 Claims, 4 Drawing Figures

IMMERSION HEATER

BACKGROUND OF INVENTION

The present invention relates to immersion heaters or devices for heating liquid in a container. Such devices are used in industrial manufacturing processes, such as electroplating and the manufacture of semiconductors where it is necessary to maintain a bath of strongly acidic or caustic solution at constant elevated temperatures.

In certain process applications where it is required to have the liquid bath shallow relative to its periphery, it has been found desirable to have the immersion heater arranged in a generally flat planar array for location at the bottom of the liquid bath beneath the basket containing the articles to be immersed for providing rapid heating of the liquid and uniformity of temperature throughout the bath where extremely accurate bath temperature control is required. A known technique for constructing immersion heaters is that of utilizing a heater cable of coiled conductor suitably encased in a flexible plastic jacket or casing impervious to caustic or acidic baths, where the heater cable is wound about a suitable support in a desired configuration such as a spiral or serpentine array. Such a heater cable assembly is described in U.S. Pat. No. 4,158,764. Such known heater cables, although flexible, have been found incapable of being folded back or bent double about a relatively short radius compared to the outer diameter of the cable jacket, without destroying the coils of the heater element.

In providing the aforesaid type flat planar array heater cable assemblies having the greatest compactness, it has been found desired to find a technique for providing a continuous heater cable capable of being bent in a closely spaced serpentine arrangement requiring folding back or bending of the heater cable about a radius on the order of less than twice the outer diameter of the cable jacket. Such a closely spaced serpentine arrangement has heretofore required cutting the heater cable coil and splicing in by silver soldering circular elbows or corner fittings made of less resistive and more flexible material such as copper wire in order to accommodate such tight or short radius bends and thus have been costly and time consuming to manufacture.

In service applications employing planar array heater cable assemblies disposed with the plane of the array horizontal and parallel to the surface of the liquid, it has been found that a hazardous overheating occurs in the event the liquid level exposes the upper portions of the cable to air while power is connected to the heater. As the liquid level drops and exposes portions of the periphery of the cable along its length to air, local overheating of the cable jacket occurs with subsequent melting of the jacket and exposure of the liquid level during operation so as to expose portions of the heater cable to air.

SUMMARY OF THE INVENTION

The present invention presents a solution to the above described problem of providing a continuous heater cable of being folded back or bent double to form a closely spaced compact serpentine planar array for applications where the planar array is disposed horizontally adjacent the bottom of the liquid container.

The present invention provides a heater cable assembly formed in closely spaced serpentine planar array.

The present invention employs a continuous heater cable folded back or bent about a radius on the order of less than twice the outside diameter of its unbent cable jacket. The present heater cable comprises a continuous heater element coiled in axially spaced pitches and encased with a flexible plastic jacket. The coiled heater element has one or more regions thereof wherein the element is uncoiled for a relatively short axial length so as to provide a linear conductor portion which enables the heater cable to be folded back as bent about the aforementioned tight or short radius. Each of the linear conductor portions is disposed between two adjacent regions of axially spaced coiled conductor. The present invention provides a solution to the above described problem of protecting a generally horizontally disposed planar array cable heater assembly from overheat due to lowered liquid bath level by providing a portion of the heater cable folded back or bent to lie along the upper surface of the planar array providing a heat sensor portion so as to be first exposed to air upon lowering of the liquid bath level. The heat sensor portion includes one or more electrically series connected protective devices each having a fusible member which melts at a temperature at or below the melting temperature of the cable jacket so as to create open circuit in the heater element upon overheating before or as the cable jacket melts.

The present invention thus includes a novel continuous flexible heater cable having regions thereof capable of being folded back or bent in closely spaced serpentine arrangement in a planar array. The cable employs a continuous coiled conductor with spaced linear regions intermediate the coiled regions with the conductor received in a flexible plastic casing. The heater cable of the present invention includes a sensor portion folded to lie along the upper surface of the planar array, which sensor portion includes at least one series protective device having a fusible member which, upon experiencing overheating, melts to go open circuit at or below the cable jacket melting temperature.

DETAILED DESCRIPTION

Figure 1:
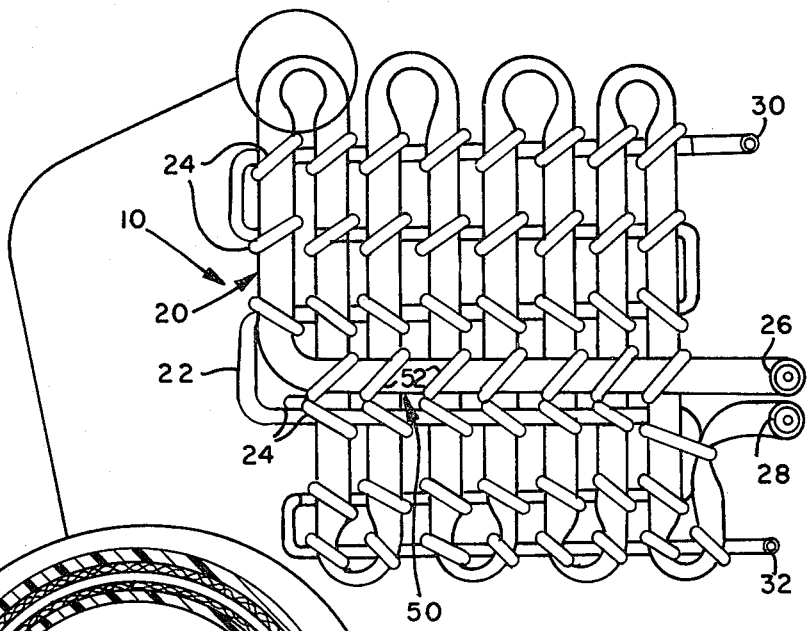
FIG. 1 is a plan view of the serpentine planar array heater assembly.
Figure 2:
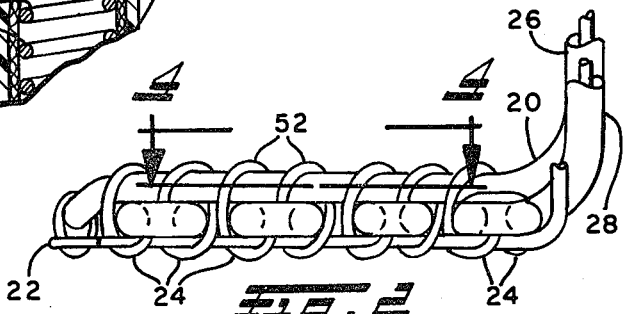
FIG. 2 is a side view of the heater assembly of FIG. 1.

Referring to FIGS. 1 and 2, the heater assembly indicated generally at 10 is shown in the presently preferred arrangement as having a continuous heater cable indicated generally at 20 and being generally folded or bent back alternately in a serpentine generally flat planar configuration. The serpentine arrangement of cable 20 is mounted on a support structure illustrated as single folded rod 22 and, the cable is secured to support rod 22 by a plurality of plastic stops or ties 24 formed of a suitable material impervious to acidic or caustic solutions. In the presently preferred practice, rod 22 is sleeved or coated with suitable plastic material such as, for example, polytetrafluoroethylene for resistance to chemical attack. A folded unitary rod support 22 is shown; however, it will be understood, that a support employing plural rods may be used. The heater cable is continuous from one vertically disposed riser lead 26 to the other vertically disposed riser lead 28. Moreover, although only a single layer or planar array of serpentine folds is shown in the drawings, it will be understood that additional layers may be employed as, for example, by folding the cable 20 into a second layer disposed on the opposite or lower side of support rod 22. Only portions of risers 26, 28 are shown, it being understood that each extends vertically above the surface of the liquid bath for connection to a source of power in a known manner. Similarly, riser portions 30, 32 of support rod 22 are shown truncated.

Figure 3:
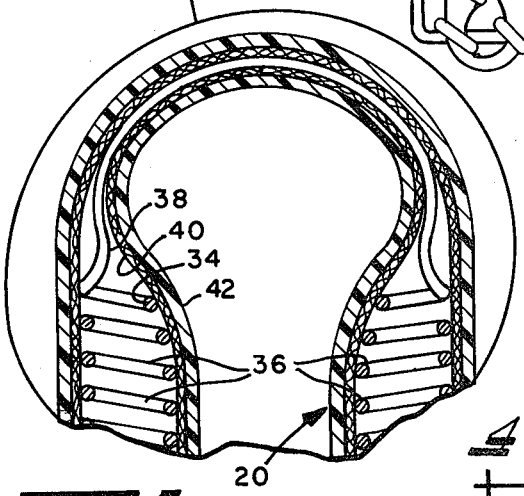
FIG. 3 is an enlarged section view of a folded portion of the heater cable in the embodiment of FIG. 1; and, FIG. 4 is an enlarged section view taken alongsections indicating lines 4—4 of FIG. 2.

Referring now to FIG. 3, the cable 20 is shown enlarged in the region of fold back as U-bend and has a continuous conductor element 34 shown coiled in axially spaced pitches 36 in the straight portion of the serpentine array. The conductor 34 is formed to an uncoiled or linear portion 38 for a length sufficient to extend through the U-bend as fold back and an uncoiled portion 38 is formed in the continuous conductor element 34 at each location along the length of cable 20 where a U-bend is to be made. The coiled conductor 34 is received in a braided sheath formed preferably of glass fiber material with the braided sheath in closely fitting, free sliding relationship. A suitable flexible outer casing 42 is received over braided sheath 40 in free sliding arrangement; and, in the preferred practice of the invention, casing 42 is formed of polytetrafluoroethylene material. Other plastics capable of elevated temperature service and resistive to acidic and caustic solutions may, however, be employed.

Figure 4:
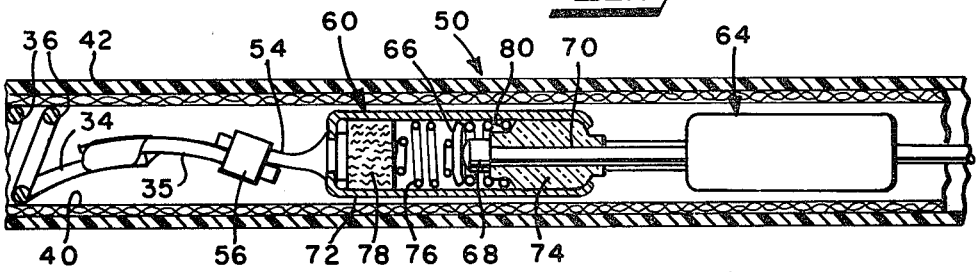

The cable 20, thus, has a conductor element 34 comprising a series of coiled portions spaced therealong, with one of said linear, uncoiled portions 38 disposed between adjacent coiled portions to thereby permit the U-bend as fold back. As shown in FIG. 1 and FIG. 3, the linear portion 38 permits the braided sheath 40 and casing 42 to distort or collapse in the region of the fold back or U-bend. In the presently preferred practice of the invention, the unique construction of cable 20 with linear or uncoiled portion 38 of conductor 34 permits the cable to be U-bent or folded back about an inside radius of less than twice the outside diameter of cable jacket 42 with only minor inconsequential disturbance of coils 36. Referring now to FIGS. 2 and 4, a sensor portion indicated generally at 50 of the cable 20 is folded to lie across the upper surface of the folds of cable 20 and is secured to the array by a plurality of ties 52. With particular reference to FIG. 4, the conductor element 34 is shown as terminated by attachment to a suitable conductive lead such as one end of copper wire 35 which has its other end connected to one lead 54 of a protective device indicated generally at 60 and hereinafter described in greater detail. Copper lead 35 is attached to one end of conductor 34 preferably by silver soldering. The other end of wire 35 is connected by any suitable means as, for example, crimp band 56 to lead 54. First protective device is preferably series connected with a second duplicate protective device indicated generally at 64 for providing greater reliability for the sensor portions 50. Devices 60 and 64 are known and commercially available from Emerson Electric Co., Micro Devices Division, P.O. Box 501, Dayton, Ohio 45419. One such device is illustrated in FIG. 4 as having a moveable contact biased in contact with the button end 68 of conductive lead 70 which is positioned within conductive housing shell 72 by insulator bushing 74. The outer periphery or rim of contact 66 is in sliding contact with the inner surface of shell 72. Bias spring 76 has one end resting against fusible member 78 which comprises a wax pellet in the presently preferred practice. A second bias spring 80 has one end registered against the end of insulator 74 and the other end resting against the right-hand face of moveable contact 66.

In the normal operating condition, contact 66 is biased against button end 68 for completing a circuit between lead 54 and lead 70 by spring 76 which is compressed between wax pellet 78 and contact 66 to exert sufficient force thereon to overcome the bias of spring 80. Upon shell 72 experiencing overheat from either excess current draw or external conduction from the liquid bath through cable casing 42, wax pellet 78 melts, releasing the compression on spring 76 and allowing spring 80 to move contact 66 leftward in FIG. 4 to a position spaced from button 68, thereby breaking the circuit to conductor 34. It will, thus, be understood that either of the protective devices 60, 64 upon experiencing current draw above a predetermined level or overheating of the liquid bath adjacent the heater cable, cause automatic open circuiting and shutdown of the heater.

The present invention thus provides a novel continuous heater cable construction having a coiled heating element with spaced regions along the length thereof remaining uncoiled to permit fold back or short radius U-bends for arrangement in a generally planar closely spaced serpentine arrangement which is secured to a suitable support. Although a serpentine array is presently preferred, it will be understood that an oval or collapsed helical arrangement may be alternately employed. The continuous heater cable has an integral portion thereof folded back across the upper surface of the planar array. The sensor portion has at least one thermally fusible protective device within the cable for open circuiting the coiled conductor element upon the sensor portion experiencing either excessive current draw or local overheating of the liquid bath adjacent the sensor portion. The sensor portion thus cuts off the heater upon experiencing low liquid level in the container.

The present invention has been described hereinabove in the presently preferred practice; however, it will be understood by those skilled in the art that modifications and variations may be made without departing from the invention which is limited only by the following claims.

It is now claimed:

1. A continuous, flexible heating cable assembly array for immersion heating of a liquid in a container, said cable array comprising:

(a) a heating element disposed in coiled pitches of substantially uniform diameter having a length substantially greater than the coil diameter, said element being formed of a continuous bare wire having a high electrical resistance;

(b) a flexible braided sheath of fibrous glass material received over said coiled pitches continuously along the length thereof;

(c) said coil heating element having at least one uncoiled region disposed intermediate the ends thereof and intermediate to regions of said coiled pitches, which region has the element disposed in axially substantially linear arrangement for a predetermined interval of length;

(d) an outer tubular casing formed of flexible, electrical insulating material having a low surface coefficient of friction and a high resistance to heat and attacks by acid and alkaline solutions, said casing being received over said sheath element and continuous along the length thereof;

(e) connecting means attached to each end of said coiled element and disposed within said casing;

(f) power lead means attached to each of said connecting means, said lead means extending beyond the respective adjacent end of said casing, said lead means being adapted for connection to a source of electrical power;

(g) said cable assembly being folded or bent at a radius less than twice the diameter of said casing in said uncoiled region without materially disturbing said coiled pitches wherein said cable assembly has a plurality of said uncoiled regions spaced therealong and forms an array of side-by-side closely spaced, unbent sections disposed in generally serpentine arrangement;

(h) support means; and, (i) means for attaching the individual sections to said support means for maintaining said side-by-side closely spaced serpentine arrangement.

2. The cable heater defined in claim 1 wherein said casing is formed of polytetrafluoroethylene plastic material.

3. The immersion heater assembly array defined in claim 1 wherein:

(a) The serpentine arrangement has a generally planar configuration; and, (b) said cable has a sensor portion thereof folded to lie along one planar surface of said serpentine arrangement, said center portion including a protected device having fusible means therein connected electrically in series with said coil heating element, said fusible means operable to melt and cause said protected device to break the electrical connection to said element upon said sensor portion experiencing a temperature near the melting point of said casing, wherein said sensor portion is operable upon immersion of said heater assembly in a liquid with said sensor portion disposed so as to be first to break the surface upon lowering of liquid level and said fusible means breaks the electrical connection upon said sensor portion experiencing either local overheating of the liquid bath or excessive current flow through said coil conductor.

4. The assembly defined in claim 3 wherein said fusible means comprises a wax pellet which melts at a temperature below the melting point of the cable casing or jacket.

5. The assembly defined in claim 3 further comprising a highly conductive connector lead intermediate the end of said coiled heating element and said fusible protective device.

6. The immersion heater assembly array defined in claim 1 wherein the cable has a sensor portion disposed on said support such that the liquid level in said container is lowered, said sensor portion is first exposed to the liquid surface and said sensor portion includes:

(i) a conductive lead attached to one end of said heater element;

(ii) protective means connected to the remaining end of said conducting means, said protective means having mountable means operative to go open circuit on experiencing excessive current draw or overheating of said liquid adjacent to said sensor portion.

7. The device defined in claim 6 wherein said conductive lead comprises a copper wire.

8. The device defined in claim 6 wherein said conductive lead comprises a copper wire having one end braced to said heater element.

* * * * *